US009045954B2

(12) United States Patent
Langeteig

(10) Patent No.: US 9,045,954 B2
(45) Date of Patent: Jun. 2, 2015

(54) INJECTION MODULE, METHOD AND USE FOR LATERAL INSERTION AND BENDING OF A COILED TUBING VIA A SIDE OPENING IN A WELL

(75) Inventor: Bjarne Kåre Langeteig, Tananger (NO)

(73) Assignee: Quality Intervention AS, Balestrand (NO)

( * ) Notice: Subject to any disclaimer, the term of this patent is extended or adjusted under 35 U.S.C. 154(b) by 265 days.

(21) Appl. No.: 13/513,250

(22) PCT Filed: Dec. 6, 2010

(86) PCT No.: PCT/NO2010/000447

§ 371 (c)(1),
(2), (4) Date: Jun. 1, 2012

(87) PCT Pub. No.: WO2011/071389

PCT Pub. Date: Jun. 16, 2011

(65) Prior Publication Data

US 2012/0241174 A1 Sep. 27, 2012

(30) Foreign Application Priority Data

Dec. 7, 2009 (NO) ..... 20093484

(51) Int. Cl.
*E21B 19/22* (2006.01)

(52) U.S. Cl.
CPC ..... *E21B 19/22* (2013.01)

(58) Field of Classification Search
CPC ..... E21B 19/22; E21B 33/068; E21B 33/047
USPC ..... 166/384, 77.1–77.3, 85.5, 90.1, 242.5, 166/313, 89.2, 88.1, 97.5
See application file for complete search history.

(56) References Cited

U.S. PATENT DOCUMENTS 4,388,969 A * 6/1983 Marshall et al. ..... 166/242.5
4,848,480 A * 7/1989 Titchener et al. ..... 166/385
4,972,904 A * 11/1990 Godare ..... 166/90.1
5,080,168 A * 1/1992 Wittrisch ..... 166/65.1

(Continued)

FOREIGN PATENT DOCUMENTS

WO WO 2010/002672 1/2010
WO WO 2010/014326 2/2010

OTHER PUBLICATIONS

International Search Report mailed Mar. 3, 2011 for International Application No. PCT/NO2010/000447.

*Primary Examiner* — Blake Michener
(74) *Attorney, Agent, or Firm* — Fay Sharpe LLP

(57) ABSTRACT

An injection module is used for lateral insertion and bending of a coiled tubing via a side opening in a well. The module is structured for connection to the side opening. The module includes injection equipment for coiled tubing operations. The distinctive characteristic of the injection module is that it also includes an insertion device connected to the injection equipment wherein the insertion device is structured in a manner allowing it to fit within the side opening in the well. A first end portion of the insertion device includes a bending head with a bending path, wherein the bending head is structured in a manner allowing it to directionally deviate the coiled tubing upon conducting the coiled tubing along the bending path. The insertion device is provided with a guide conduit extending from a second end portion of the insertion device and onwards to the bending head for allowing the coiled tubing to be conducted into the bending head.

18 Claims, 9 Drawing Sheets

(56) References Cited

U.S. PATENT DOCUMENTS

| | | | | |
|---|---|---|---|---|
| 5,188,174 | A * | 2/1993 | Anderson, Jr. | 166/77.3 |
| 5,279,364 | A * | 1/1994 | Jantzen et al. | 166/77.3 |
| 5,469,925 | A * | 11/1995 | Mueller et al. | 175/61 |
| 5,775,417 | A * | 7/1998 | Council | 166/77.3 |
| 5,927,405 | A | 7/1999 | Monjure et al. | |
| 6,047,776 | A * | 4/2000 | Kiang et al. | 166/379 |
| 6,186,239 | B1 * | 2/2001 | Monjure et al. | 166/384 |
| 6,289,992 | B1 * | 9/2001 | Monjure et al. | 166/384 |
| 6,315,046 | B1 * | 11/2001 | Jack et al. | 166/312 |
| 6,851,478 | B2 * | 2/2005 | Cornelssen et al. | 166/368 |
| 6,964,306 | B2 * | 11/2005 | Bunney | 166/382 |
| 7,069,995 | B2 * | 7/2006 | Chan et al. | 166/312 |
| 7,686,091 | B2 * | 3/2010 | Jennings et al. | 166/385 |
| 7,699,099 | B2 * | 4/2010 | Bolding et al. | 166/89.1 |
| 7,721,798 | B2 * | 5/2010 | Angman | 166/77.1 |
| 7,762,327 | B2 * | 7/2010 | Jennings | 166/255.1 |
| 7,770,653 | B2 * | 8/2010 | Hill et al. | 166/379 |
| 7,823,648 | B2 * | 11/2010 | Bolding et al. | 166/375 |
| 8,327,934 | B2 * | 12/2012 | Jennings | 166/255.1 |
| 8,403,039 | B2 * | 3/2013 | Howell et al. | 166/242.5 |
| 8,528,651 | B2 * | 9/2013 | Darby et al. | 166/385 |
| 2002/0074122 | A1 * | 6/2002 | Kelley et al. | 166/313 |
| 2002/0134548 | A1 | 9/2002 | Lam et al. | |
| 2004/0154790 | A1 * | 8/2004 | Cornelssen et al. | 166/75.13 |
| 2005/0109518 | A1 * | 5/2005 | Blacklaw | 166/383 |
| 2007/0000670 | A1 * | 1/2007 | Moore et al. | 166/384 |
| 2009/0288832 | A1 * | 11/2009 | Comeaux et al. | 166/298 |
| 2010/0018721 | A1 * | 1/2010 | Jennings et al. | 166/385 |
| 2010/0319933 | A1 * | 12/2010 | Baugh | 166/381 |
| 2011/0079402 | A1 * | 4/2011 | Darby et al. | 166/385 |
| 2012/0247754 | A1 * | 10/2012 | Wright et al. | 166/84.1 |
| 2012/0305237 | A1 * | 12/2012 | Thornburrow | 166/181 |

* cited by examiner

INJECTION MODULE, METHOD AND USE FOR LATERAL INSERTION AND BENDING OF A COILED TUBING VIA A SIDE OPENING IN A WELL

AREA OF THE INVENTION

The present invention concerns an injection module, a method and a use for lateral insertion and bending of a coiled tubing via a side opening in a well.

The well may be a subsea well or a land-based well. As such, the well may any type of well, for example a petroleum well, an injection well, a water well or a geothermal well.

For example, the side opening of the well may be connected to a well pipe, for example a production tubing, or an annulus between casings in the well. Typically, the side opening will be connected to a pipe stub provided with a valve, for example a gate valve, or one or more meters, for example a pressure gauge, thermometer or similar.

BACKGROUND OF THE INVENTION

The background of the invention is in problems associated with undesirable pressure build-up especially in annuli, but also in well pipes, in underground wells. This pressure build-up results from associated pressure barrier failures in such wells. Typically, such pressure barriers consist of cement, well liquids, packers, plugs and casings. The purpose of such pressure barriers is to prevent undesirable leakage and flow of well fluids to the surface, but also to/from permeable formations communicating with a well.

Pressure barrier failure may arise in any phase of the lifetime of a well and, depending on the type of well and well phase, such a failure may cause various unfortunate and possibly disastrous consequences. Thus, pressure barrier failure constitutes a problem both in new and old wells, including old wells that have been plugged and abandoned.

Pressure build-up and possible fluid leakages in annuli may arise due to poorly executed cementing jobs. Fluid-conveying channels may also be formed in the cement in the annulus due to setting-related and/or earthquake-related movements in one or more formations surrounding a well. Such setting-related and/or earthquake-related movements may also damage packers, plugs and other well pressure counteracting equipment in a well and thus result in pressure build-up and possible fluid leakages in the well.

Salt water and/or other corrosive fluids in a well may also disintegrate casings, packers plugs and similar in the well and eventually cause pressure build-up and possible fluid leakages in the well.

Incidentally, a well pressure counteracting liquid, for example drilling mud containing weighting materials for increasing the density of the liquid, and which is positioned in an annulus/well pipe for some considerable time, may eventually segregate and deposit its weighting material. Thereby, the majority of the liquid will assume a smaller density and hence will lose its well pressure counteracting effect. This may then cause pressure build-up and possible fluid leakages in the well.

For a production well, pressure barrier failure may lead to shut-down of the production from the well. Pressure barrier failure may also result in undesirable fluid leakage to other permeable formations in the underground. Thus, a leakage in an oil well may cause oil to flow to a groundwater-permeable formation penetrated by the well so as to contaminate the water in the groundwater-permeable formation.

For a plugged and abandoned well, such pressure barrier failure may result in undesirable flow of well fluids to the surface and/or to one or more formations penetrated by the well. Also this may unfortunate and possibly disastrous consequences, for example extensive pollution and related environmental problems.

In this context, comprehensive and international statistics exist over wells encumbered with problems related to such pressure barrier failure. These problems may have large consequences with respect to operations, time, cost, safety and the environment.

PRIOR ART AND DISADVANTAGES THEREOF

In order to remedy problems related to pressure build-up in annuli and well pipes, it is customary to conduct fluidized cement, sealing material and/or well pressure counteracting liquid to the particular area of the well.

In context of pressure build-up in an annulus in a well, it is known to pump a high density liquid, for example drilling mud, into an upper end of the annulus and thus counteract the elevated pressure in the annulus. However, the high density liquid will sink relatively slow downwards through the annulus simultaneous with lighter liquid being displaced upwards. This is a relatively slow and ineffective process which does not always work satisfactorily.

In context of such pressure build-up in an annulus, so-called squeeze cementing may also be carried out in the particular area of the annulus, or injection of a sealing material into the annulus may be carried out. When so doing, however, a squeeze cementing tool or an injection tool must be inserted into a well pipe, for example a casing, located immediately inside of the particular annulus. At least one hole through the well pipe must also be formed before the squeeze cementing or the injection can be initiated.

When said pressure build-up/leakage relates to a hole in a casing in a well, a remedying scab liner may be inserted into the casing and disposed in a pressure-sealing manner around the hole by means of suitable packers. By so doing, the liner constitutes a pressure-tight casing patch for the casing.

It is also known to use drill pipes and coiled tubing, which is inserted into a well pipe in order to fill cement into a leaking area of the well pipe. Then a sidetrack is carried out from a shallower level in the well.

All of these pressure-remedying operations are extensive, time-consuming, costly and/or ineffective.

On the other hand, said problems related to pressure build-up in well pipes, and especially in annuli, may be remedied to a large extent if a pressure-remedying fluid is conducted into the particular well annulus and further downwards to the problematic area of the annulus.

In this context, the closest prior art therefore appears to be represented by the following patent publications:

U.S. Pat. No. 5,927,405; and

U.S. Pat. No. 6,186,239.

U.S. Pat. No. 6,186,239 represents a further development of the technical solutions disclosed in U.S. Pat. No. 5,927,405.

Thus, U.S. Pat. No. 5,927,405 describes an arrangement for remedying pressure build-up in an annulus in a well by inserting a flexible hose, for example a hose formed from an elastomer material, into the annulus via a gate valve and a side opening in a wellhead. During the insertion, the hose must be pressurized for rendering it sufficiently rigid to allow it to be displaced downwards in the annulus. In this context, the lower end of the hose is temporarily blocked by means of a nozzle, burst disc or similar which holds the pressure in the hose during the insertion. After the insertion, the pressure in the hose is increased until the nozzle opens or the burst disc breaks. Then a high density liquid is pumped down into the annulus via the hose so as to lower the pressure in the annulus. In one embodiment, said side opening in the wellhead is formed as a downwardly bent passage leading into the annulus for allowing the hose to be guided in a downward direction during the insertion thereof in the annulus. In another embodiment, a hose guide bushing is used for this purpose. The hose guide bushing is screwed into a straight side opening in the wellhead and connects the annulus to the outside of the wellhead. Further, the hose guide bushing comprises a downwardly bent passage structured in a manner allowing it to guide the hose in a downward direction during the insertion thereof in the annulus.

U.S. Pat. No. 6,186,239 shows further details of such lateral insertion of a flexible hose in an annulus, including details of an injection system that is to push (inject) the hose into the annulus via said side opening in the wellhead. This injection system comprises, among other things, a blowout preventer ("BOP"), sealing elements and a cutting device for the hose. Moreover, U.S. Pat. No. 6,186,239 describes an end fitting capable of being screwed into the side opening, and which may be connected to an upper end of the hose after being conducted into the annulus and the upper end of the hose being severed by means of said cutting device. By so doing, the hose may be left behind in the annulus for potential use later.

OBJECTS OF THE INVENTION

A principal object of the invention is to provide a technical solution rendering possible to conduct a coiled tubing into a well via a side opening therein.

Another object of the invention is to provide a technical solution rendering possible to conduct a fluid, for example a fluidized treatment agent into a well via a side opening therein, and by means of coiled tubing.

A further object of the invention is to provide a technical solution which at least reduces one or more of the above-mentioned disadvantages of the prior art in-order to prevent pressure build-up in a well.

A more specific object is to provide a technical solution which, relative to known solutions, is relatively simple, flexible, compact and cheap, and which is space-saving and weight-wise light in use.

The objects are achieved by virtue of features disclosed in the following description and in the subsequent claims.

GENERAL DESCRIPTION OF HOW TO ACHIEVE THE OBJECTS

In a first aspect of the present invention, an injection module for lateral insertion and bending of a coiled tubing via a side opening in a well is provided, wherein the module is structured for connection to the side opening, and wherein the module comprises injection equipment for coiled tubing operations. The distinctive characteristic of the injection module is that it also comprises an insertion device connected to said injection equipment;

- wherein the insertion device is structured in a manner allowing it to fit within the side opening in the well;
- wherein a first end portion of the insertion device comprises a bending head with a bending path, wherein the bending head is structured in a manner allowing it to directionally deviate the coiled tubing upon conducting the coiled tubing along the bending path; and
- wherein the insertion device is provided with a guide conduit extending from a second end portion of the insertion device and onwards to the bending head for allowing the coiled tubing to be conducted into the bending head.

Insofar as this injection module comprises its own insertion device with an associated bending head for a coiled tubing, the injection module distinguishes significantly from the technical solutions according to the above-mentioned U.S. Pat. No. 5,927,405 and U.S. Pat. No. 6,186,239. As mentioned above, both of these publications concern lateral insertion of a flexible hose, not a coiled tubing, into an annulus in a well. The insertion of the hose is carried out via a hose bending device in the form of a downwardly bent passage formed in the sidewall of a wellhead, or in the form of a downwardly bent passage formed in a guide bushing screwed into a straight side opening in the wellhead. In both cases, the wellhead must be specially adapted in advance with such a bending device to allow the hose to be conducted into the annulus of the well.

The latter, however, is not required when using the present injection module for lateral insertion of a coiled, tubing in a well. In this context, side openings and/or pipe stubs being insignificantly adapted or not adapted for this purpose, may be used, for example a standard side bore in a wellhead or similar.

Further, said injection equipment for coiled tubing operations may typically comprise a suitable blowout preventer ("BOP"), stuffing box or stripper, a lubricator with suitable sealing elements, at least one shear ram, various associated fittings and a conveyor device for coiled tubing. An injection apparatus with a heavy duty, chain-based conveyor device is described, for example, in U.S. Pat. No. 5,188,174. The conveyor device is also used for withdrawing the coiled tubing when required. Such injection equipment, however, constitutes prior art and will not be discussed in further detail herein.

Out of necessity, the coiled tubing to be conducted into the well via said side opening must have an outer dimension fitting into the particular cavity in the well, for example in a production tubing, in an annulus between two sizes of casing, or in an annulus between a formation wall and a casing. Especially during insertion in an annulus, the coiled tubing must have a relatively small outer diameter for allowing it to fit into the annulus.

Typically, such a coiled tubing will be coiled upon a spool or reel for spooling in or out therefrom. Even though the spool or reel may be connected to the injection module, the spool/reel will typically be present as a separate unit which must be connected to the injection module. The coiled tubing may also be connected to pumping equipment for introduction of a fluid in the well, for example a fluidized treatment agent. Equipment for this purpose constitute prior art per se. Further, this fluid may be comprised of, for example, a well killing fluid, including a high density liquid, or of cement, a sealing agent or another, suitable well treatment agent.

After having connected the injection module to the side opening of the well, and after having conducted the insertion device into the particular well area to which the side opening is connected, for example a well pipe or an annulus, the coiled tubing is pushed (injected) into the well via the insertion device so as to become directionally deviated along the bending path in said bending head.

The nose portion (front end) of the coiled tubing may be directionally deviated before or after having connected the injection module to the side opening of the well. If the directional deviation is carried out before connecting the injection module to the side opening, the nose portion of the coiled tubing will be prepared for further insertion in the well once the injection module is connected to the side opening. This renders possible to quickly initiate the continued insertion of the coiled tubing in the well.

As a consequence of this direction deviation in the bending head, the coiled tubing may discharge from the bending head in a direction substantially parallel to the particular well pipe or annulus. The coiled tubing is injected into the well by means of the conveyor device of the injection module, the device of which the coiled tubing must be connected to first before initiating the injection. In this context, the nose portion of the coiled tubing may be provided with an insertion head or similar device which is rounded or chamfered in order to facilitate the insertion of the coiled tubing. Such an insertion head is shown in said U.S. Pat. No. 5,927,405.

Advantageously, the present injection module may also be structured for releasable connection to said side opening. By so doing, the injection module may be used as a transportable unit capable of being moved from well to well, as required.

In one embodiment, the insertion device of the injection module may also be connected to a moving means disposed on the injection module;

wherein the moving means is structured in a manner allowing it to move, the insertion device relative to the injection module after the connection thereof to the side opening in the well.

For example, this moving means may comprise a movable piston. This piston may mechanically, hydraulically, pneumatically or electrically operated and possible be disposed in an associated piston cylinder. As an addition or alternative, the moving means may comprise at least one pitch rack guide, for example in the form of a rotatable, toothed bar/rack connected to a toothed pinion/gear, motor or similar driving device for rotation of the toothed bar/rack. As such, the insertion device may be thread-connected to the toothed bar/rack. Thereby, the insertion device will be able to move in the desired direction through suitable rotation of the toothed bar/rack.

Advantageously, the insertion device of the injection module may be cylinder-shaped or sleeve-shaped for allowing it to fit within a circular side opening in the well, for example a side bore in a wellhead. Typically, such a side bore will be connected to a horizontal pipe stub, the free end of which is provided with a coupling flange. The pipe stub may also comprise at least one valve, for example a gate valve, and at least one measuring instrument, for example a pressure gauge.

Yet further, said guide conduit in the insertion device may be comprised of a bore formed in the insertion device.

Moreover, the bending path of the insertion device may be formed through casting of the bending head. In this context, the bending head must be formed from a suitable casting material capable of enduring the loads inflicted by the coiled tubing on the bending head during the movement of the coiled tubing along the bending path. For example, the bending head may thus be formed from cast iron or some other metallic material, or an alloy of cast iron and some other metallic material, or from composite materials. The resulting bending path may also be given a finishing treatment for obtaining a hard-wearing surface, for example by means of a hard facing.

As an alternative, the bending head may comprise at least two cooperating profile parts having complementarily shaped contact surfaces collectively defining the bending path. Such profile parts may be cast or machined into the respective, complementary shape. The profile parts must also be able to endure the loads inflicted by the coiled tubing on the profile parts during the movement of the coiled tubing along the bending path between the profile parts. Thus, the profile parts may be formed from the same materials mentioned in the preceding example, and said contact surfaces may possibly be given a finishing treatment for obtaining hard-wearing surfaces, for example by means of hardfacings.

As a further alternative, the bending head may comprise at least two cooperating wheels collectively defining at least a portion of the bending path, wherein the cooperating wheels are structured in a manner allowing them to directionally deviate the coiled tubing along the bending path upon conducting the coiled tubing between the wheels. For example, such cooperation may be achieved by virtue of the wheels having complementarily shaped circumferences. Thus, the bending head may comprise one or more sets of cooperating wheels bending and guiding the coiled tubing along the bending path. The wheels must be able to endure the loads inflicted by the coiled tubing on the wheels during the movement of the coiled tubing along the bending path between the wheels. Thus, the wheels may be formed from steel or composite materials and, at the circumferences thereof, the wheels may possibly be given a finishing treatment for obtaining hard-wearing surfaces, for example by means of hardfacings.

Further, the insertion device may comprise a directional stabilizer disposed at an outlet from the bending head for directional control of the coiled tubing after the outlet. The purpose of such a directional stabilizer is to function as a counteracting impact surface against which the discharging coiled tubing impinges and hence is straightened out after the coiled tubing has been bent inside the bending head. The directional stabilizer may be comprised of at least one guiding device or similar, for example a guide rail, a guiding groove, a guide edge, a guide plate or a guide block, which guides the coiled tubing in the correct downward direction for the continued insertion in the well. A directional stabilizer, however, does not constitute a prerequisite for allowing the coiled tubing to be conducted onwards into the well. Without such a directional stabilizer, the coiled tubing may impinge on a pipe wall, whereby the pipe wall will function as a counteracting and directionally controlling impact surface for the coiled tubing. The impact force inflicted by the coiled tubing on the directional stabilizer or a pipe wall will also be dependent on the degree of bending of the coiled tubing when being conducted through said bending head.

In addition, the insertion device may be provided with a return flow conduit for potential return flow of a fluid from the well. Thereby, a fluid volume displaced by the fluid being pumped down into the well via the coiled tubing may flow out of the well via said return flow conduit.

Yet further, the bending path of the insertion device may be structured in a manner allowing it to directionally deviate the coiled tubing by approximately 90 degrees, i.e. to directionally deviate the coiled tubing approximately perpendicular relative to the direction of the coiled tubing before being conducted through the bending head.

Alternatively, the bending path of the insertion device may be structured in a manner allowing it to directionally deviate the coiled tubing by less than 90 degrees, for example in the region of 20-80 degrees relative to the direction of the coiled tubing before being conducted through the bending head. As such, it appears to be advantageous to choose ca. 15, 30, 45, 60 or 75 degrees directional deviation of the coiled tubing. This, however, assumes that the direction of the coiled tubing before being conducted through the bending head is non-horizontal, and that the side opening of the well and/or a pipe stub connected thereto also is non-horizontal. Advantageously, the well may thus be provided with such a non-horizontal side opening and/or pipe stub, for example in connection with a wellhead. By directionally deviating the coiled tubing by less than 90 degrees, it will also be possible to use a larger and more standardized diameter on the coiled tubing to be injected into the well. This presupposes that it is possible to conduct such a larger coiled tubing into the particular cavity in the well. Additionally, this presupposes that the present injection module is structured in a manner allowing it to conduct the insertion device thereof and the coiled tubing in a corresponding, non-horizontal direction before conducting the coiled tubing into the bending head of the insertion device. For example, this may be carried out by virtue of the very injection module being structured in a manner allowing it to be positioned obliquely relative to the base thereof, or by virtue of the injection module's injection equipment, including said conveyor device, being disposed in an oblique position relative to the base.

In a second aspect of the present invention, a method for lateral insertion and bending of a coifed tubing via a side opening in a well is provided. The distinctive characteristic of the method is that it comprises the following steps:

(A) using a separate injection module comprising injection equipment for coiled tubing operations and an insertion device connected to the injection equipment, wherein the insertion device comprises the following features:

- a first end portion comprising a bending head with a bending path; and
- a guide conduit extending from a second end portion of the insertion device and onwards to the bending head;

(B) connecting the injection module to said side opening in the well and conducting the insertion device into the side opening;

(C) conducting the coiled tubing into the well via the insertion device and its guide conduit and bending path in said bending head so as to directionally deviate the coiled tubing; and (D) conducting the coiled tubing onwards into the well to a desired location.

In this context, the nose portion of the coiled tubing may be directionally deviated before or after connecting the injection module to the side opening of the well, as mentioned above.

The features and comments relating to the injection module according to the first aspect of the invention also are applicable to the injection module used in the method according to the second aspect of the invention.

Advantageously, in step (B) of the present method, the injection module may be releasable connected to said side opening. By so doing, the injection module may be moved from well to well, as required.

In step (D) of the method, the coiled tubing may be conducted into an annulus in the well, for example in an annulus between two sizes of casing, or in an annulus between a formation wall and a casing. Alternatively, the coiled tubing may be conducted into a well pipe in the well, for example a production tubing.

After step (D), the method may also comprise a step (E) of conducting a fluid, for example a fluidized treatment-agent, through the coiled tubing and onwards to the desired location in the well. For example, this location may be located in vicinity of a leaking packer or cement in an annulus or casing in the well.

Thus, the fluid may be comprised of a well killing fluid, for example drilling mud, or of cement or of a sealing agent.

In this context, at least one annulus and/or well pipe in a well to be plugged and abandoned, may be filled fully or partly in advance with at least one suitable fluid, for example cement and/or a fluidized sealing material. By so doing, the well is prepared for plugging and abandonment.

It is also conceivable to conduct other types of fluids into the well via such a coiled tubing, for example fluids used in context of a well workover or well stimulation, including acid and propping agent, or gas for gas lift operations, including. $CO_2$. Moreover, it is conceivable to use such a coiled tubing for injection of fluids or fluidized materials in an underground formation. Thus, the coiled tubing may be used to inject water and/or gas in a permeable formation in order to maintain the pressure in the formation and hence the production of fluids from the formation. It is also conceivable to use the coiled tubing for injection of fluidized waste materials, for example fluidized drill cutting or similar, in an underground formation.

It is emphasized, however, that the essential part in this context is not what the coiled tubing may be used for, but that it is possible to conduct a coiled tubing into a well, and particularly into an annulus thereof, via a side opening in the well. This presupposes that the coiled tubing is bent somewhat in context of the initial insertion into the well. This is the very problem to which the present invention provides a solution.

Further, and according to the method, a potential return flow of a fluid from the well may be conducted out via a separate outlet opening in the well, for example a side outlet in a wellhead. This outlet opening is separate from said side opening for connection of the injection module.

Alternatively, the method may comprise the following:

- in step (A), using an insertion device comprising a return flow conduit; and
- in step (E), allowing a return flow of a fluid from the well to flow out via the return flow conduit. coiled tubing may flow out of the well via said return flow conduit.

Further, the method may also comprise the following:

- in step (A), using an insertion device comprising a bending path structured in a manner allowing it to bend the coiled tubing by approximately 90 degrees; and
- in step (C), conducting the coiled tubing through the bending path so as to directionally deviate the coiled tubing by approximately 90 degrees.

This implies that the coiled tubing is directionally deviated approximately perpendicular relative to the direction of the coiled tubing before being conducted through the bending head.

Alternatively, the method may comprise the following:

- in step (A), using an insertion device comprising a bending path structured in a manner allowing it to bend the coiled tubing by less than 90 degrees; and
- in step (C), conducting the coiled tubing through the bending path so as to directionally deviate the coiled tubing by less than 90 degrees.

This implies that the coiled tubing is directionally deviated by less than 90 degrees, for example in the region of 20-80 degrees relative to the direction of the coiled tubing before being conducted through the bending head. As such, it appears to be advantageous to directionally deviate the coiled tubing by ca. 15, 30, 45, 60 or 75 degrees relative to the initial insertion direction of the coiled tubing.

Yet further, the method may also comprise the following:

- in step (A), connecting the insertion device to a moving means disposed on the injection module; and
- in step (B), and after having connected the injection module to the side opening of the well, conducting the insertion device into said side opening by means of the moving means.

This moving means is described in further detail in context of the above-mentioned, first aspect of the invention.

In a further embodiment, the method may also comprise the following:

after step (D), separating the coiled tubing from the injection module; and connecting the separated coiled tubing to the side opening of the well, whereby the coiled tubing is fixedly installed in the well.

Such a solution may be advantageous if it is desirable to fixedly mount a coiled tubing in the well, for example in an annulus thereof. By so doing, the well is prepared for future well operations. For example, it may concern introduction of a pressure-remedying fluid should a potential pressure build-up occur in the well. Alternatively, such a fixedly mounted coiled tubing may be used for gas lift purposes, for water injection or for injection of waste materials into an underground formation.

A third aspect of the invention concerns use of an injection module according to the above-mentioned, first aspect of the invention for lateral insertion and bending of a coiled tubing via a side opening in a well.

Hereinafter, non-limiting exemplary embodiments of the present invention will be shown.

SHORT DESCRIPTION OF FIGURES OF THE EXEMPLARY EMBODIMENTS

FIG. 1 shows a side perspective of an injection module according to the invention connected to a coiled tubing extending from a separate coiled tubing spool;

is FIGS. 2-6 illustrate, in various perspectives, how the injection module is connected to a side bore in a wellhead, and how a cylinder-shaped insertion device of the injection module then is conducted into the side bore, the insertion device being provided with a first embodiment of a bending head;

Figure 9:
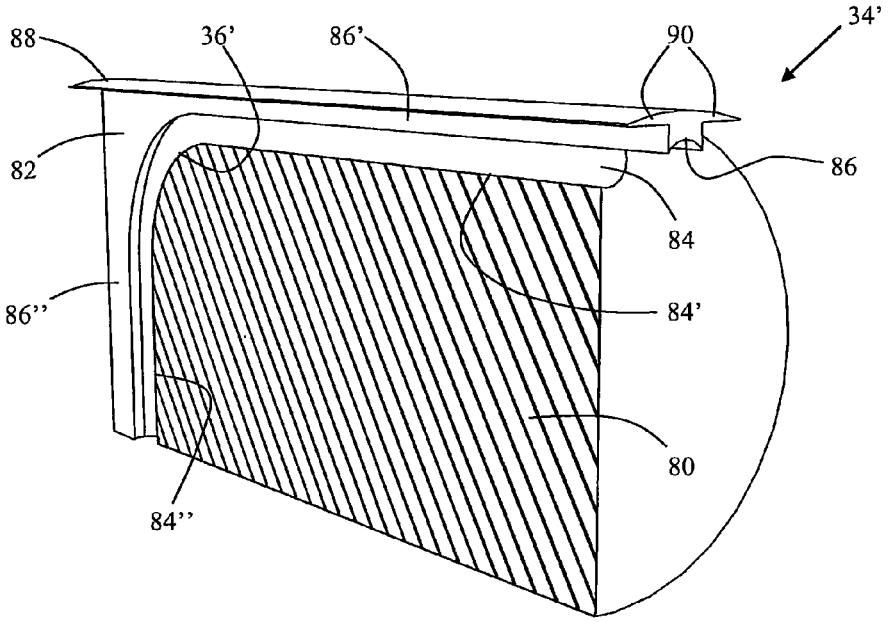
FIG. 9 shows, partially in section, a side perspective of a second embodiment of a bending head for the insertion device according to the invention.
Figure 10:
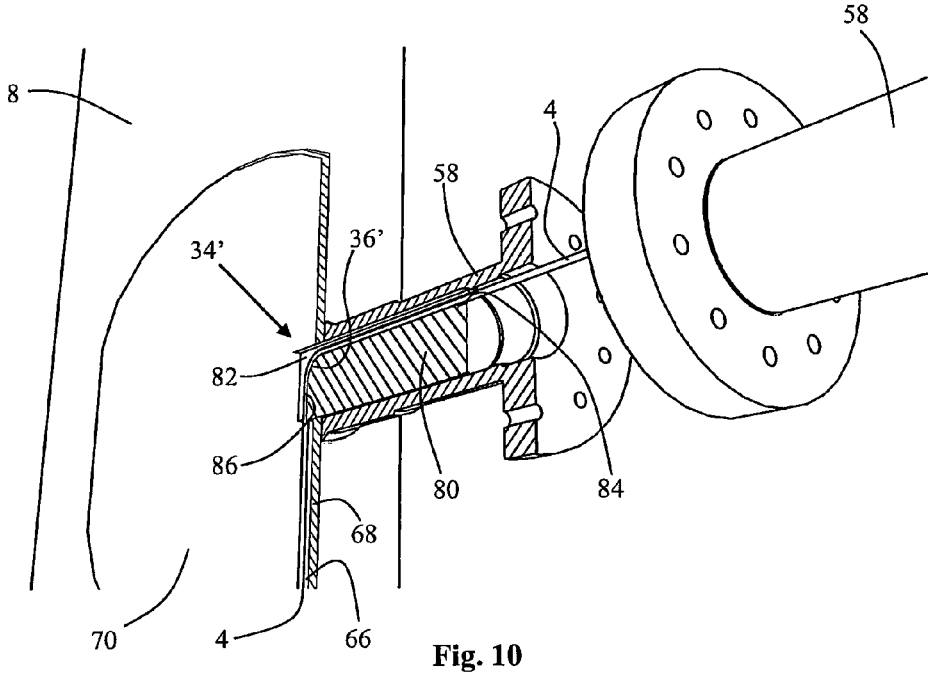
Figure 11:
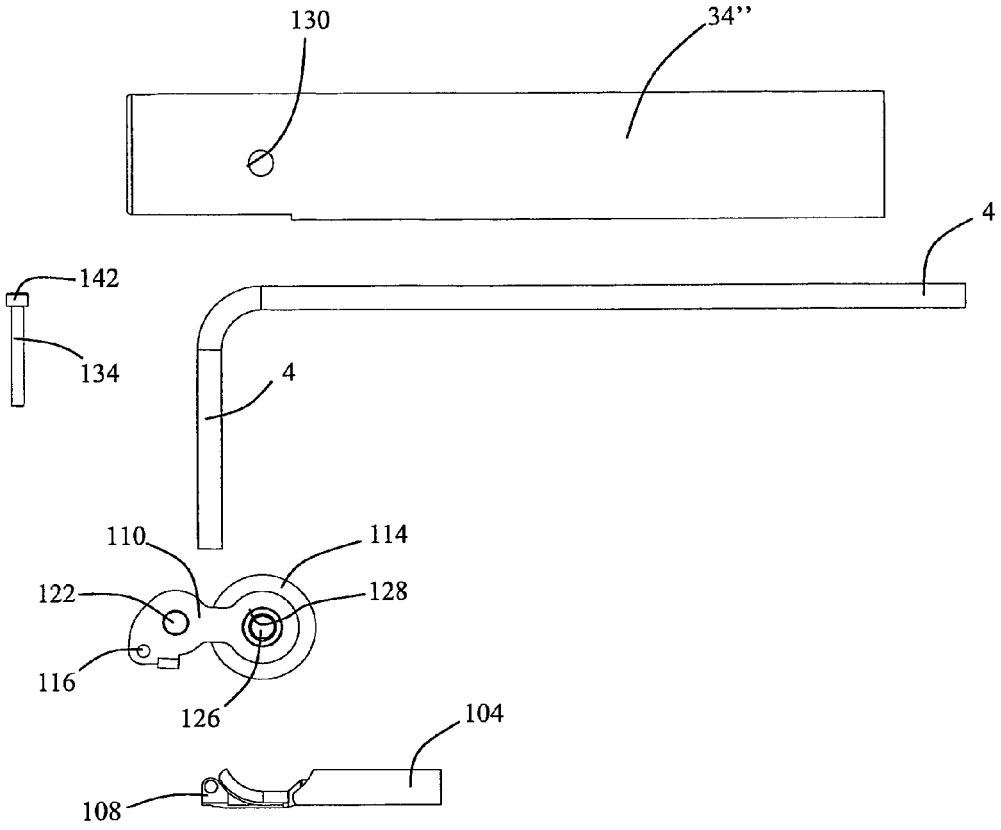
Figure 12:
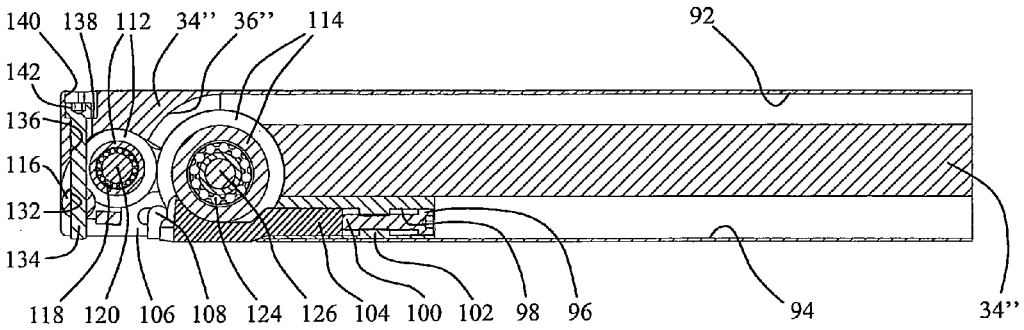

FIG. 10 shows, in smaller scale and in a partially exploded view, a side perspective of the bending head according to FIG. 9 whilst said coiled tubing is being conducted into an annulus in the wellhead via this bending head for the insertion device; and FIGS. 11-17 show in sections and in partially exploded views, among other things, various perspectives of a third embodiment of a bending head for the insertion device according to the invention. schematic and simplified concerning richness in detail with respect to components and equipment shown in the figures. Such components and equipment may also be somewhat distorted with respect to their relative sizes and placements relative to other components and equipment included in the exemplary embodiments. In general, identical, equivalent or corresponding details of the figures will be denoted with the same or similar reference numerals in the following.

DESCRIPTION OF EXEMPLARY EMBODIMENTS OF THE INVENTION

FIGS. 1-7 show an injection module 2 according to the invention connected to a thin coiled tubing 4 coiled upon a separate coiled tubing spool 6 placed in immediate vicinity of the injection module 2. The spool 6 and the coiled tubing 4 may also be connected to a line (not shown) for allowing, at a later point in time, pumping of a treatment agent, for example a well killing fluid, via the coiled tubing 4 and into an underground well. In this embodiment, the injection module 2 and the coiled tubing spool 6 are placed beside a wellhead 8 on a wellhead deck 10 on an offshore platform. On the other hand, the injection module 2 and the coiled tubing spool 6 may just as well be placed beside a wellhead on a land-based well.

The injection module 2 comprises a frame structure 12 provided, among other things, with various injection equipment for coiled tubing operations. As viewed in the insertion direction of the coiled tubing 4, this injection equipment in this embodiment comprise a heavy duty conveyor device 14 for the coiled tubing 4; a shear ram 16 connected to a respective inlet 18 and outlet 20 for hydraulic fluid for activation of the shear ram 16; and a stuffing box 22 connected to a flexible return hose 24. The stuffing box 22 contains at least one packer element which, by means of an associated piston device, is forced in a pressure-sealing manner around the coiled tubing 4 when being conducted through the stuffing box 22. Such injection equipment constitute prior art. An example of a conveyor device resembling the present conveyor device 14, is described in detail in the above-mentioned U.S. Pat. No. 5,188,174. Seen further in the insertion direction of the coiled tubing 4, the stuffing box 22 is connected in a pressure-sealing manner to an insertion device according to the invention. In this context, FIGS. 1-7 show a lengthy and cylinder-shaped insertion device 26 through which the coiled tubing 4 may be conducted, as required.

Furthermore, said conveyor device 14 contains two parallel and endless chains 28, 30, each of which is disposed in a rotatable manner around a respective set of chain sprocket wheels (not shown). Nearby and opposite sides of the chains 28, 30 are also arranged with some distance therebetween so as to allow them, when in their positions of use, to conduct the coiled tubing 4 between the opposite chain sides. In addition, each chain 28, 30 is provided with continuous, external gripping elements (nto shown) which, when in their positions of use, are forced against the coiled tubing 4 so as to grip it simultaneously with the chains 28, 30 rotating synchronously for conveyance of the coiled tubing 4. Driving devices and associated equipment for the purpose of forcing said gripping elements towards the coiled tubing 4, and for the purpose of rotating said chain sprocket wheels and thus the chains 28, 30, are not shown in the figures. For example, such driving devices may be comprised of rotary motors and hydraulic cylinders with associated pistons. By means of the conveyor device 14, the coiled tubing 4 may be conducted onwards through the shear ram 16, the stuffing box 22 and into the insertion device 26, which will be explained in further detail in the following. Thereby, the conveyor device 14, the shear ram 16, the stuffing box 22 and the insertion device 26 are assembled in a coaxial manner for conducting the coiled tubing 4 along a mutual axis.

Figure 8:
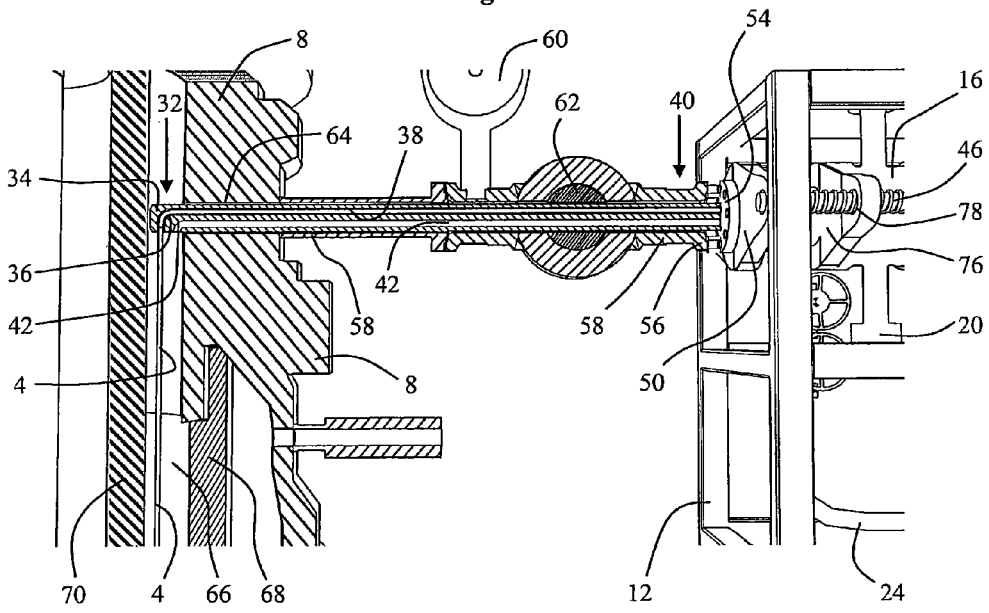
FIG. 8 shows, in larger scale, a section through the insertion device and the wellhead shown in FIG. 7.

As shown best in FIG. 8, said insertion device 26 comprises a first end portion 32 comprised of a cast bending head 34 according to a first embodiment thereof. A bending path 36 is formed within the bending head 34 during the casting thereof. The bending head 34 is structured in a manner allowing it to directionally deviate the coiled tubing 4 by ca. 90 degrees when conducted along the bending path 36. The insertion device 26 is also provided with a guide conduit in the form of a first bore 38 extending from a second end portion 40 of the insertion device 26 and onwards to the bending head 34. Thereby, the coiled tubing 4 may be conducted forward and be pushed into the bending head 34 by means of the conveyor device 14. Moreover, the insertion device 26 is provided with a return flow conduit in the form of a second bore 42 extending between the first and second end portions 32, 40 of the insertion device 26. The guide conduit 38 and the return flow conduit 42 are shown best in FIG. 6.

In this embodiment of the injection module 2, both the injection equipment for coiled tubing operations and the insertion device 26 are structured so as to be horizontally movable relative to the frame structure 12. For this purpose, the frame structure 12 is provided with a moving means comprising, among other things, two parallel and horizontal thread bars, i.e. a first thread bar 44 and a second thread bar 46, which are disposed at a distance from each other. The thread bars 44, 46 have threads of a self-locking type. By means of suitable bearings (not shown in the figures), the ends of the thread bars 44, 46 are supported in rotatable manner in respective sides of a first support plate 48 (closest to the spool 6) and a second support plate 50 (closest to the wellhead 8), respectively. The support plates 48, 50 are secured at either end of the frame structure 12. In order to be rotated in the desired direction of rotation when required, the thread bars 44, 46 are connected to at least one driving device (not shown), for example an electric or hydraulic rotary motor. The second support plate 50 is also provided with a respective centre hole 52 through which the insertion device 26 is conducted during use. Furthermore, the second support plate 50 is provided with a ring-shaped connector 54 disposed on the outside of the support plate 50 and around the centre hole 52 thereof. The connector 54 is used for pressure-tight connection of the injection module 2 to a coupling flange 56 on a horizontal pipe stub 58 provided with a pressure gauge 60 and a gate valve 62, and which is connected to a side bore 64 on the wellhead 8. Further, the side bore 64 communicates with an annulus 66 between two sizes of casing, i.e. a first casing 68 and a second casing 70, in the wellhead 8.

The moving means of the frame structure 12 also comprises a first, second and third moving plate 72, 74, 76 movably connected to the thread bars 44, 46 via corresponding threaded holes 78 also having self-locking threads, and which are disposed in respective sides of each moving plate 72, 74, 76. By so doing, the conveyor device 14 is attached between the first and second moving plate 72, 74, whereas the shear ram 16 and the stuffing box 22 are attached to the second and third moving plate 74, 76. These equipment components 14, 16, 22 with associated equipment are also disposed between the thread bars 44, 46. Upon appropriate rotatition of the thread bars 44, 46, these equipment components with associated equipment will therefore move horizontally relative to the frame structure 12, which is placed on the wellhead deck 10. Insofar as the threads on the thread bars 44, 46 and in the threaded holes 78 in the moving plates 72, 74, 76 are of a self-locking type, these thread connections will ensure that the insertion device 26 and the equipment components 14, 16, 22 with associated equipment do not move out of the pipe stub 58 and the gate valve 62 when the insertion device 26 is subjected to a well pressure in the annulus 66.

Figure 1:
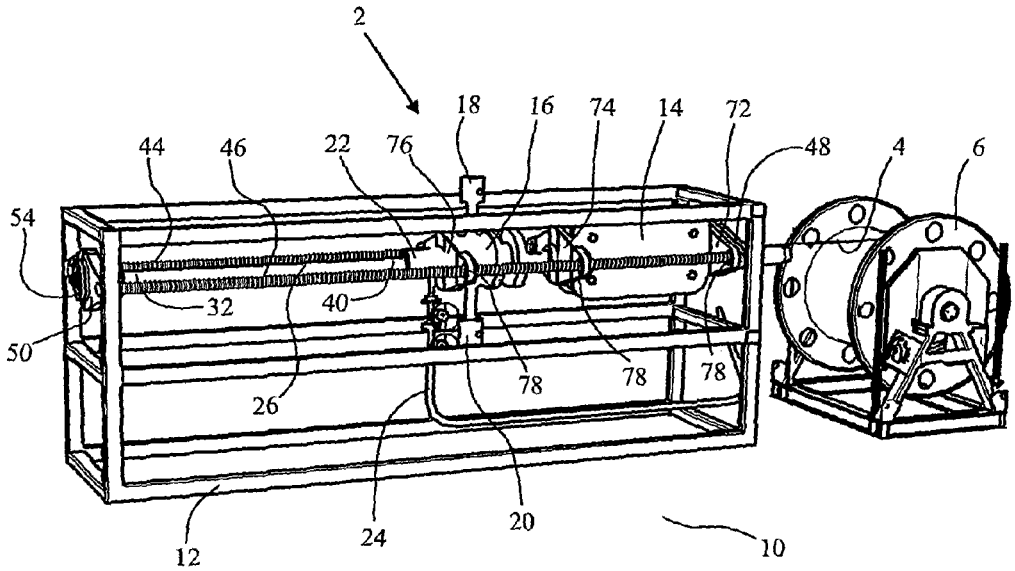
Figure 2:
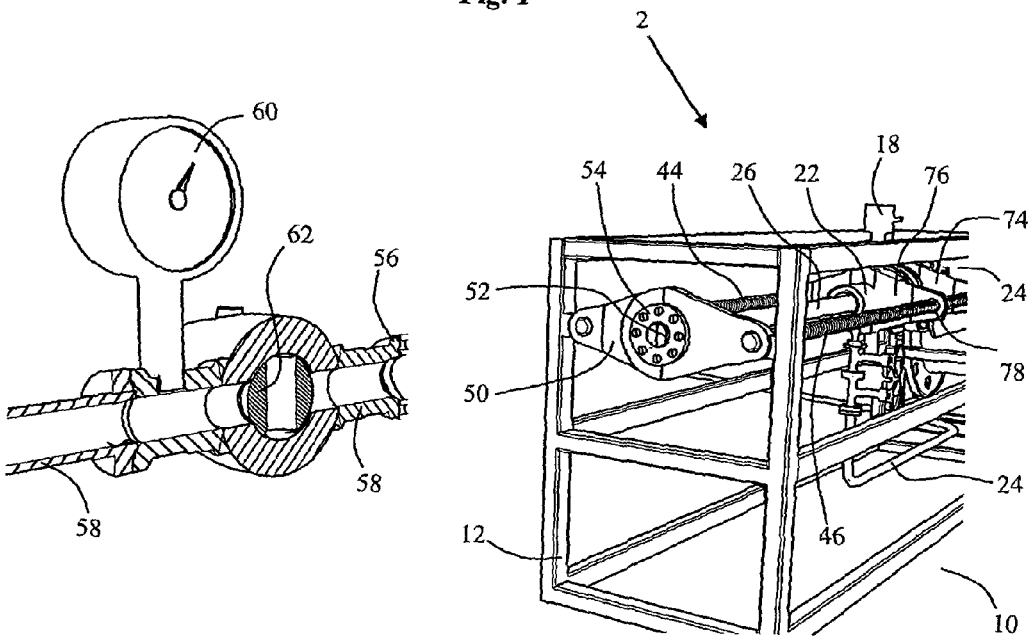
Figure 3:
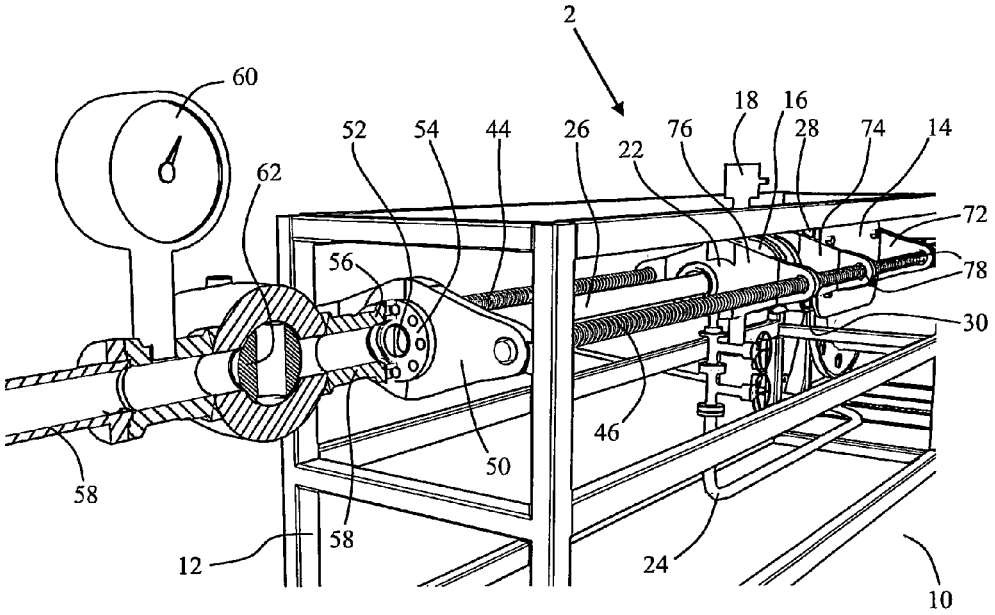
Figure 4:
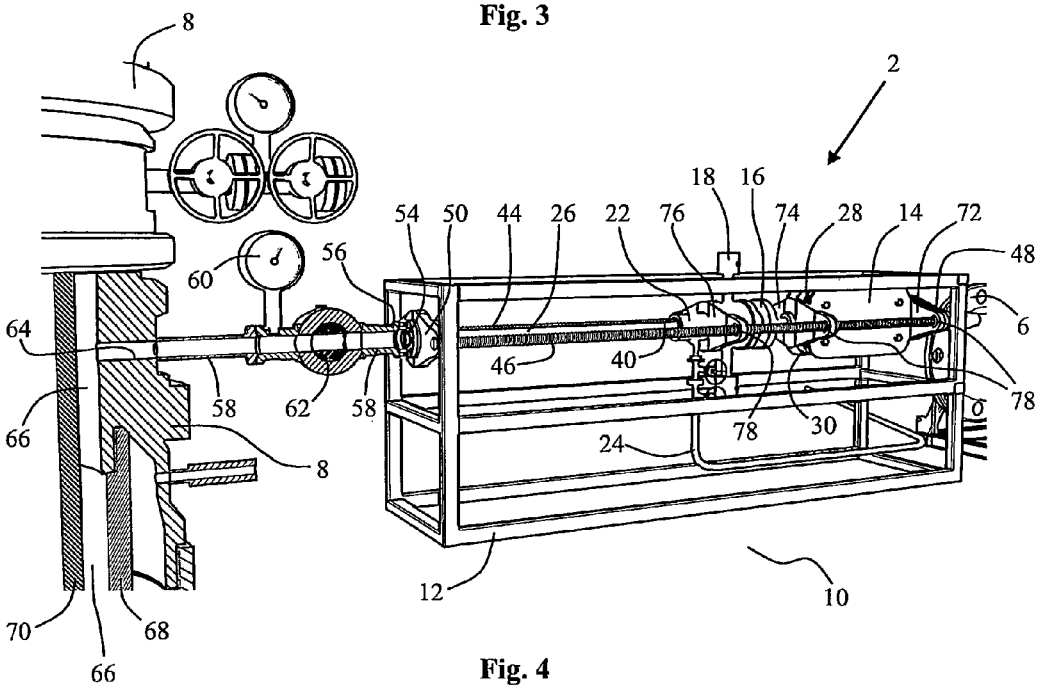
Figure 5:
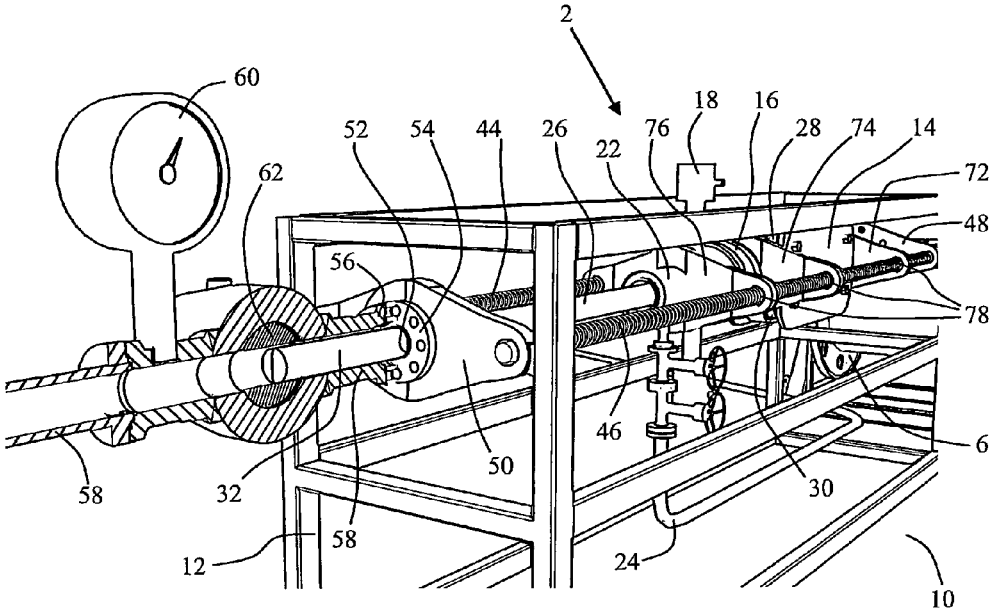
Figure 6:
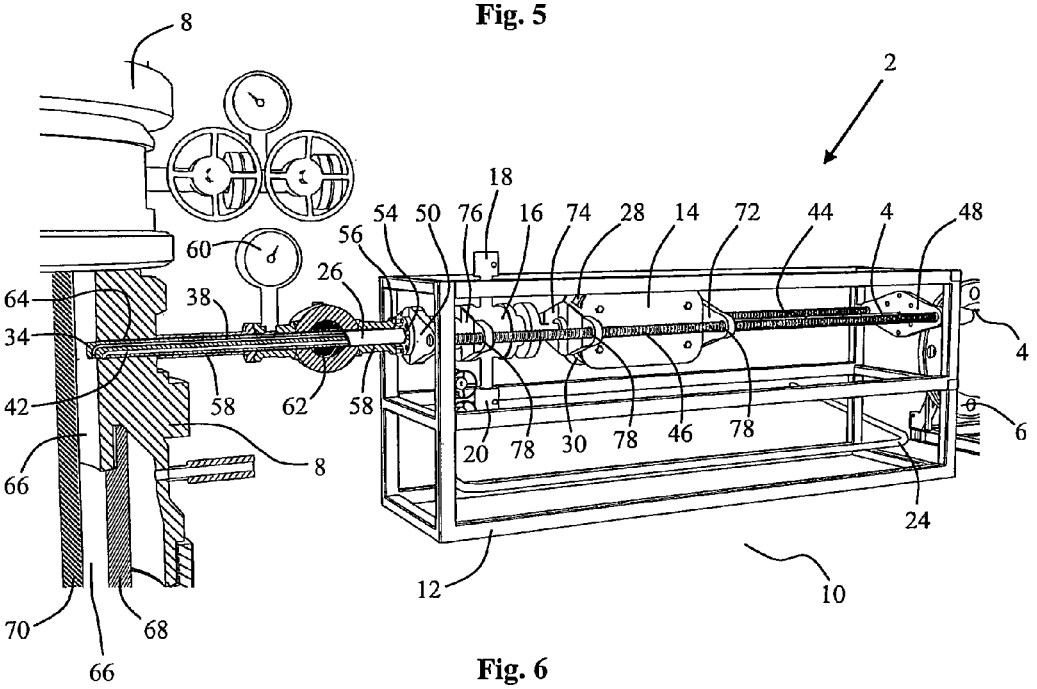
Figure 7:
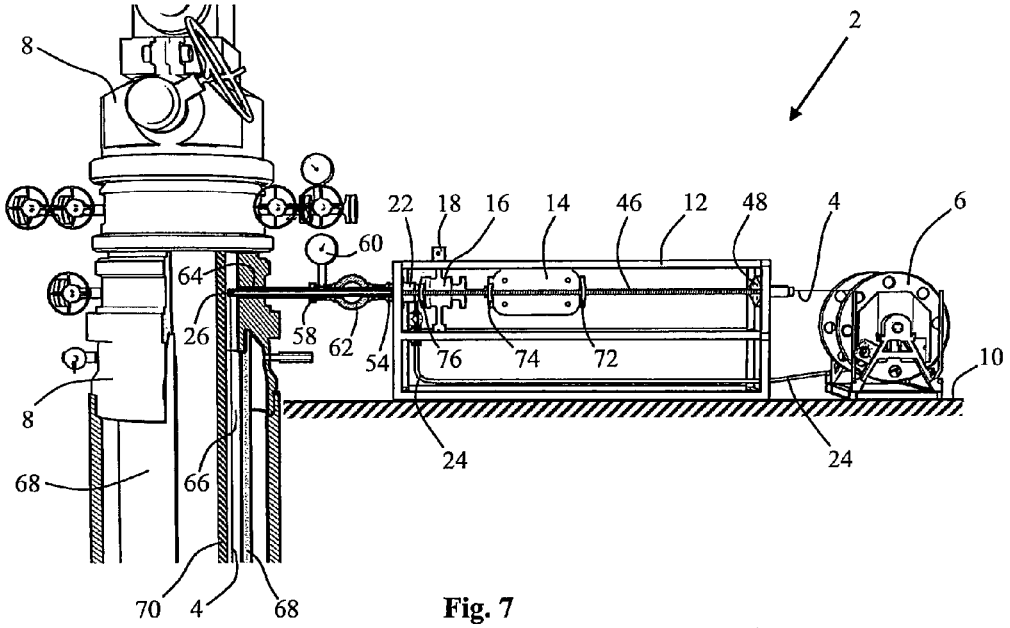
FIG. 7 shows, partially in section, a side perspective of the injection module and the insertion device according to FIGS. 2-6 whilst said coiled tubing is being conducted into an annulus in the wellhead via the insertion device.

First, and according to the present method, the separate injection module 2 is connected to said horizontal pipe stub 58 on the wellhead 8, after which it is possible to carry out a lateral insertion and bending of the coiled tubing 4 via said side bore 64 in the wellhead 8. This connection is carried out by connecting, in a pressure-sealing manner, said connector 54 on the injection module 2 to the coupling flange 56 on the pipe stub 58, as shown in FIGS. 2 and 3. In this context, the gate valve 62 on the pipe stub 58 will be closed. After the connection, the gate valve 62 is opened, after which the insertion device 26 is conducted through the centre hole 52 in the connector 54 and onwards through the pipe stub 58 and the side bore 64 until the bending head 34 is placed in the annulus 66 of the wellhead 8, as shown in FIGS. 4-6. The horizontal displacement of the insertion device 26, the stuffing box 22, the shear ram 16 and the conveyor device 14 in the direction of the wellhead 8, is carried out through appropriate rotation of the thread bars 44, 46 of the injection module 2, as explained above. Then the endless chains 28, 30 of the conveyor device 14 are activated and pushed the coiled tubing 4, which in advance has been conducted into the equipment components 14, 16, 22 and through the first bore 38 (the guide conduit) of the insertion device 26 and onwards via the bending path 36 of the bending head 34. Thus, the nose portion of the coiled tubing 4 has been prepared in advance for continued insertion in the annulus 66 once the injection module 2 has been connected to the side bore 64 in the wellhead 8. By so doing, the coiled tubing 4 is directionally deviated by ca. 90 degrees so as to discharge from the bending head is 34 facing downwards into the annulus 66, and substantially parallel to the casings 68, 70, as shown in FIGS. 7 and 8. Then the coiled tubing 4 is pushed further downward into the annulus 66 to a desired location in an associated well to which the wellhead 8 is connected. By so doing, a suitable fluid, for example a heavier well killing fluid, may be pumped through the coiled tubing 4 and down to this location in the annulus 66. In this context, the fluid already located in the annulus 66, and which is displaced by the fluid being pumped down into the annulus 66 via the coiled tubing 4, may flow out of this upper portion of the annulus 66 via said second bore 42 (the return flow conduit) in the insertion device 26.

After having completed the pumping of fluid into the annulus 66 and the particular downhole operation, the coiled tubing 4 may be withdrawn from the annulus 66. As an alternative thereto, the coiled tubing 4 may possibly be separated from the injection module 2. Then the separated coiled tubing 4 is connected to the side bore 64 of the wellhead 8. By so doing, the coiled tubing 4 is fixedly installed in the annulus 66 and is prepared for future well operations.

Reference is now made to FIGS. 9 and 10, which show a cylinder-shaped bending head 34' according to a second embodiment thereof. This bending head 34' is disposed at the first end portion 32 of the insertion device 26 and is hydraulically connected to the second end portion 40 of the insertion device 26, for example via a lengthy connector.

Even though this bending head 34' is not provided with a return flow conduit, which is contrary to the preceding bending head 34, also the bending head 34' may be provided with such a return flow conduit. This bending head 34' comprises two cooperating profile parts, i.e. a first profile part 80 and a second profile part 82. The profile parts 80, 82 have complementarily shaped contact surfaces, i.e. a first contact surface 84 and a second contact surface 86, collectively defining a bending path 36' structured in a manner allowing it to directionally deviate the coiled tubing 4 by ca. 90 degrees.

The first profile part 80 is comprised of a massive, circular cylinder provided with an external groove (only shown in part), the innermost part of which has a shape forming the first contact surface 84 defining one surface portion of the bending path 36'. This groove also comprises a longitudinal groove portion 84' on the upper side of the profile part 80, and a transverse groove portion 84" at the outer end of the profile part 80. Viewed in cross-section, the contact surface 84 forms a partial circle.

The second profile part 82, however, is comprised of a slender angle profile fitting into said groove in the first profile part 80, and which internally has a shape forming the second contact surface 86. A mid-portion of this contact surface 86 defines the remaining, opposite surface portion of the bending path 36'. The inside of the angle profile 82 also comprises a longitudinal groove portion 86' and a transverse groove portion 86". Viewed in cross-section, the second contact surface 86 forms a partial circle fitting in a complementary manner together with the first contact surface 84 so as to collectively define the bending path 36'. Externally the second profile part 82 is also formed with a longitudinal, arcuate strip 88 with peripheral, outwardly-directed flanks 90 fitting into corresponding recesses (not shown) in the external groove in the first profile part 80. When positioned in these recesses in the external groove, the strip 88 and its flanks 90 will complement the external, circular shape of the first profile part 80. Thereby, the bending head 34' may be readily conducted into said annulus 66 via the pipe stub 58 of the wellhead 8, as shown in FIG. 10.

Reference is now made to FIGS. 11-17, which show a cylinder-shaped bending head 34" according to a third embodiment thereof. Also this bending head 34" is disposed at the first end portion 32 of the insertion device 26 and is hydraulically connected to the second end portion 40 of the insertion device 26, for example via a lengthy connector.

Figure 13:
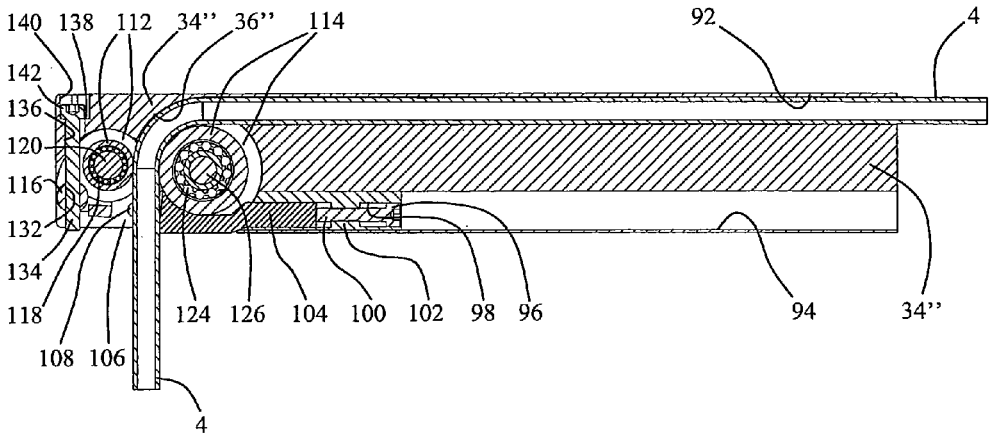
Figure 14:
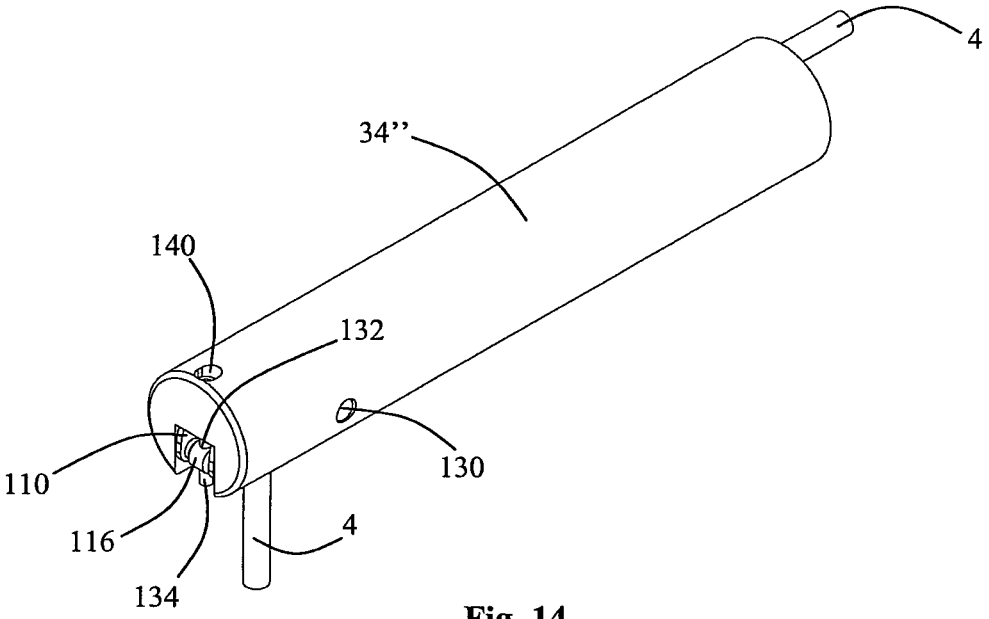
Figure 15:
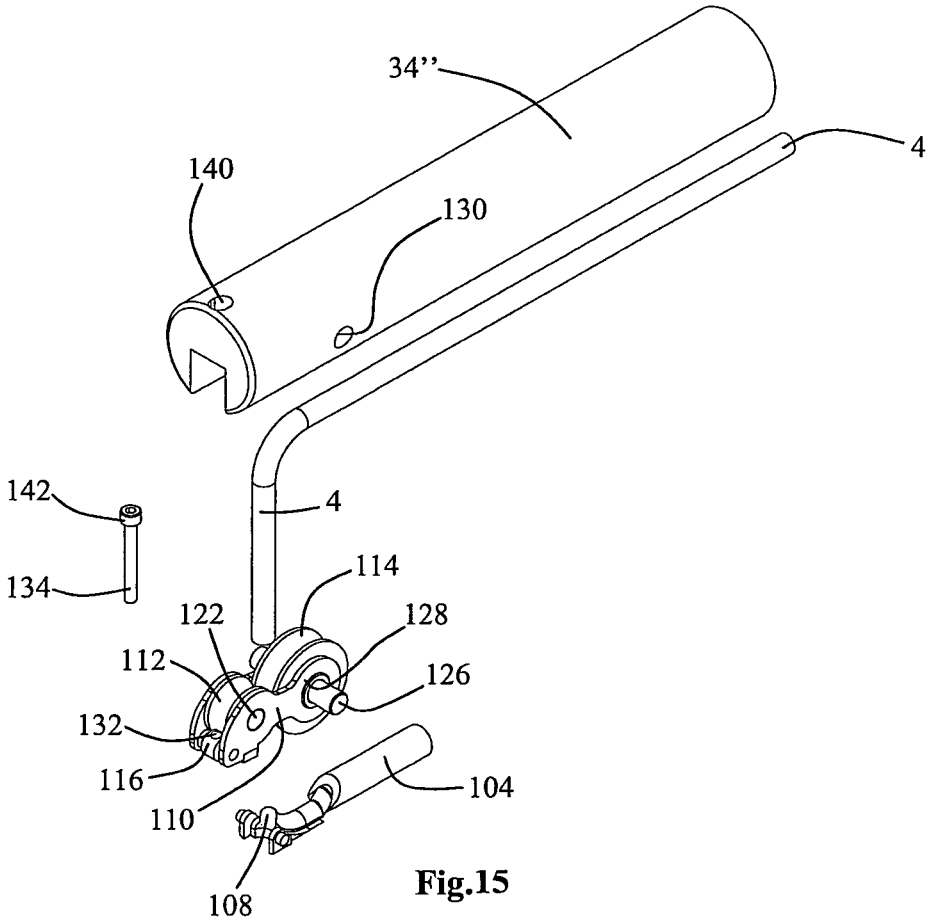
Figure 16:
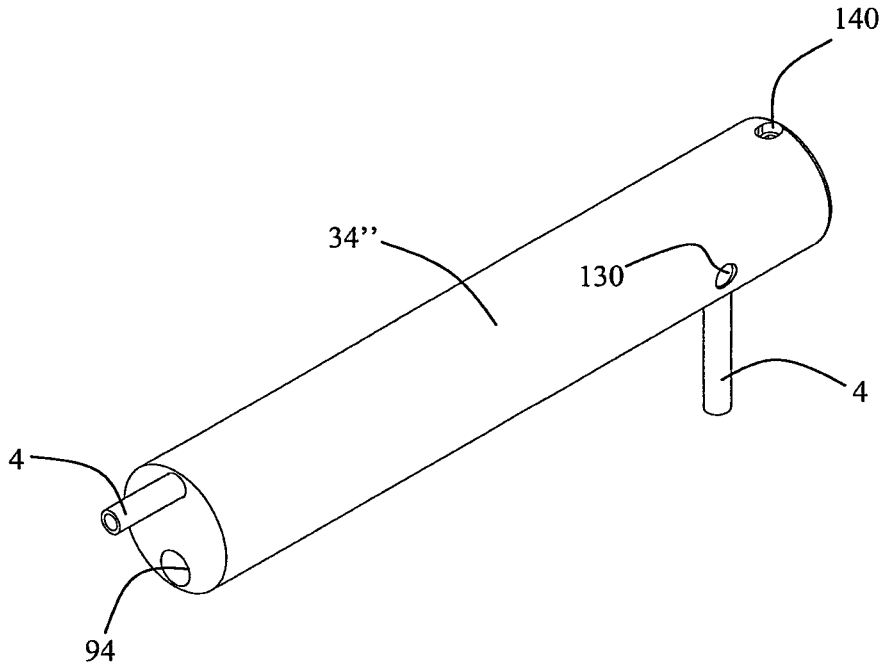
Figure 17:
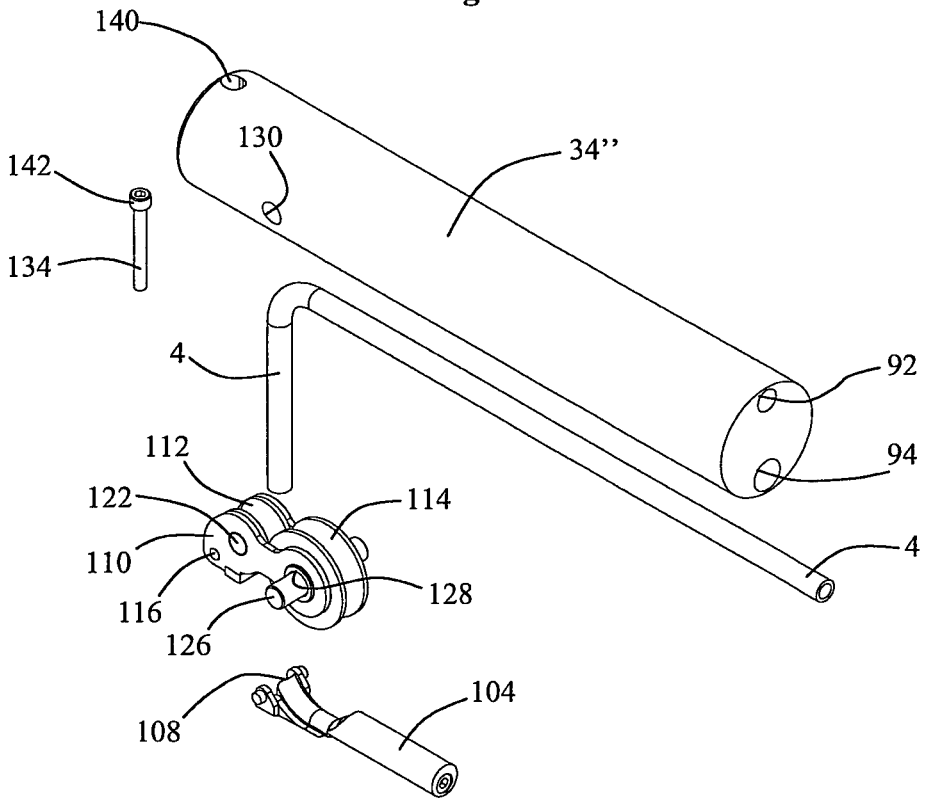

The bending head 34" according to this third embodiment comprises, among other things, a front end within which a bending path 36" is formed. Also this bending path 36" is structured in a manner allowing it to directionally deviate the coiled tubing 4 by ca. 90 degrees. The bending head 34" also comprises a straight portion provided with a bore 92 (guide conduit) for the coiled tubing 4 and a hydraulics bore 94; cf. FIGS. 12, 13, 16 and 17. The bore 92 continues onwards to the bending path 36", whereas the hydraulics bore 94 continues onwards to a movable piston 96 disposed in hydraulic cylinder 98. The piston 96 is connected to a piston rod 100 conducted through a hole in a partition wall 102, and which is connected to a lengthy directional stabilizer 104 disposed directly at an outlet 106 from the bending head 34". These elements are shown best in FIGS. 12 and 13, which show longitudinal sections through the bending head 34". The directional stabilizer 104 is also provided with a rounded contact surface 108, which is to support the coiled tubing 4 laterally and hence directionally steer it when discharging from the bending head 34", as shown in FIG. 13. The supportive force exerted by the directional stabilizer 104 on the coiled tubing 4 in this context, may be adjusted by means of the piston 96 and the hydraulic pressure supplied via the hydraulics bore 94.

The bending head 34" also comprises a wheel frame 110 provided with two cooperating and rotatable wheels, i.e. a first wheel 112 and a somewhat larger, second wheel 114, and a transverse bolt 116 suspended in the wheel frame 110 at an outer end thereof. In this embodiment, the wheels 112, 114 have complementarily shaped circumferences which, when assembled vis-à-vis each other, defines a lower portion of the bending path 36". Viewed in cross-section, each opposite wheel circumference thus forms a partial circle. Furthermore, the wheels 112, 114 are disposed with some distance therebetween so as to allow them to conduct the coiled tubing 4 therebetween, as shown in FIG. 13. The first wheel 112 is rotatably arranged via a needle bearing 118 attached around a transverse axle 120 supported in two first holes 122 in the wheel frame 110. The second wheel 114, however, is rotatably arranged via a needle bearing 124 attached around a transverse axle 126 carried through two second holes 128 in the wheel frame 110 (cf. FIGS. 11, 15 and 17), and which are supported in two holes 130 in the very bending head 34" (cf. FIGS. 14 and 16, among other places). Supported in this manner, the first wheel 112 may be rotated somewhat around the transverse axle 126 attached to the very bending head 34". Suitably, this construction may be used to adjust the pressure force exerted by the first wheel 112 on the coiled tubing 4 when being conducted through the bending path 36". For this reason, said transverse bolt 116 at the outer end of the wheel frame 110 is provided with a threaded hole 132 through which a threaded bolt 134 is screwed. Further, the threaded bolt 134 is carried through a passage 136 in the front and upper end of the bending head 34". This passage 136 continues up to a shoulder 138 in a recess 140 at the top of the bending head 34". A bolt head 142 of the threaded bolt 134 is supported on this shoulder 138. Upon screwing the threaded bolt 134 in the desired direction relative to the threaded hole 132 in the transverse bolt 116, the first wheel 112 may be rotated in the desired direction around the transverse axel 126 supported in the bending head 34". By so doing, the first wheel 112 may be raised or lowered relative to the coiled tubing 4 when conducted between the wheels 112 and 114, as shown in FIG. 13. By so doing, also said pressure force on the coiled tubing 4 may be adjusted suitably. The pressure force on the coiled tubing 4 will increase when the first wheel 112 is lowered, whereas the pressure force will be reduced upon raising the wheel 112. This raising- and lowering function of the first wheel 112 may also be achieved by connecting the transverse bolt 116 in the wheel frame 110 to a piston (not shown) connected to a hydraulic, pneumatic or electric driving device (not shown) placed in the bending head 34". Such a driving device may possibly be structured for remote activation and control. In this context, the bending head 34" may also be provided with various meters, electronics, etc. for feedback and control of the driving device and the position of the first wheel 112 in the bending head 34" and with respect to the coiled tubing 4.

In this embodiment, a return flow of a fluid from the annulus 66 may be conducted via a potential return flow conduit (not shown) arranged in the bending head 34" between the bore 92 for the coiled tubing 4 and the hydraulics bore 94. Such a return flow conduit may also be in flow communication with a corresponding return flow conduit arranged in the remaining part of the insertion device 26.

The invention claimed is:

1. An injection module for lateral insertion and bending of a coiled tubing via a side opening in a well, wherein the module is structured for connection to the side opening, and wherein the module comprises injection equipment for coiled tubing operations, wherein the module also comprises an insertion device directly connected to said injection equipment;

wherein the insertion device is structured in a manner allowing it to fit within the side opening in the well;

wherein a first end portion of the insertion device comprises a bending head with a bending path, wherein the bending head is structured in a manner allowing it to directionally deviate the coiled tubing upon conducting the coiled tubing along the bending path; and wherein the insertion device is provided with a guide conduit extending from a second end portion of the insertion device and onwards to the bending head for allowing the coiled tubing to be conducted into the bending head;

wherein the insertion device and the injection equipment are together movable on the injection module, allowing the insertion device and the injection equipment to move together relative to the remainder of the injection module after the connection of the injection module to the side opening in the well.

2. The injection module according to claim 1, wherein said guide conduit is comprised of a bore in the insertion device.

3. The injection module according to claim 1, wherein said bending path is formed through casting of the bending head.

4. The injection module according to claim 1, wherein the bending head comprises at least two cooperating profile parts having complementarily shaped contact surfaces collectively defining the bending path.

5. The injection module according to claim 1, wherein the bending head comprises at least two cooperating wheels collectively defining at least a portion of the bending path, wherein the cooperating wheels are structured in a manner allowing them to directionally deviate the coiled tubing along the bending path upon conducting the coiled tubing between the wheels.

6. The injection module according to claim 1, wherein the insertion device comprises a directional stabilizer disposed at an outlet from the bending head for directional control of the coiled tubing after the outlet.

7. The injection module according to claim 1, wherein the insertion device is provided with a return flow conduit for return flow of a fluid from the well.

8. A method for lateral insertion and bending of a coiled tubing via a side opening in a well, wherein the method comprises the following steps:

(A) using a separate injection module comprising injection equipment for coiled tubing operations and an insertion device directly connected to the injection equipment, wherein the insertion device comprises the following features:

a first end portion comprising a bending head with a bending path; and a guide conduit extending from a second end portion of the insertion device and onwards to the bending head;

wherein the insertion device and the injection equipment are together movable on the injection module;

(B) connecting the injection module to said side opening in the well and moving the insertion device and the injection equipment together relative to the remainder of the injection module, thereby conducting the insertion device into the side opening;

(C) conducting the coiled tubing into the well via the insertion device and its guide conduit and bending path in said bending head so as to directionally deviate the coiled tubing; and (D) conducting the coiled tubing onwards into the well to a desired location.

9. The method according to claim 8, wherein the method, after step (D), also comprises a step (E) of conducting a fluid through the coiled tubing and onwards to the desired location in the well.

10. The method according to claim 9, further comprising conducting a return flow of a fluid from the well out via a separate outlet opening in the well.

11. The method according to claim 9, wherein the method also comprises the following:

in step (A), the insertion device further comprises a return flow conduit; and in step (E), allowing a return flow of a fluid from the well to flow out via the return flow conduit.

12. An injection module for lateral insertion and bending of a coiled tubing via a side opening in a well, wherein the module is structured for connection to the side opening, and wherein the module comprises injection equipment for coiled tubing operations, wherein the module also comprises an insertion device directly connected to said injection equipment;

wherein the insertion device is structured in a manner allowing it to fit within the side opening in the well;

wherein a first end portion of the insertion device comprises a bending head with a bending path, wherein the bending head is structured in a manner allowing it to directionally deviate the coiled tubing upon conducting the coiled tubing along the bending path;

wherein the insertion device is provided with a guide conduit extending from a second end portion of the insertion device and onwards to the bending head for allowing the coiled tubing to be conducted into the bending head; and wherein the bending head comprises at least two cooperating wheels collectively defining at least a portion of the bending path, wherein the cooperating wheels are structured in a manner allowing them to directly deviate the coiled tubing along the bending path upon conducting the coiled tubing between the wheels.

13. The injection module according to claim 12, wherein said guide conduit is comprised of a bore in the insertion device.

14. The injection module according to claim 12, wherein said bending path is formed through casting of the bending head.

15. The injection module according to claim 12, wherein the bending head comprises at least two cooperating profile parts having complementarily shaped contact surfaces collectively defining the bending path.

16. The injection module according to claim 12, wherein the insertion device comprises a directional stabilizer disposed at an outlet from the bending head for directional control of the coiled tubing after the outlet.

17. The injection module according to claim 12, wherein the insertion device is provided with a return flow conduit for return flow of a fluid from the well.

18. The injection module according to claim 12, wherein the injection module includes a frame structure and the insertion device is adapted to be movable relative to the frame structure.

* * * * *